US005433025A

United States Patent [19]

Borghese

[11] Patent Number: 5,433,025

[45] Date of Patent: Jul. 18, 1995

[54] MOVABLE HAND SIGN AND METHOD OF ASSEMBLING THE SAME

[75] Inventor: Scipione Borghese, New York, N.Y.

[73] Assignee: Zyborg, Inc., New York, N.Y.

[21] Appl. No.: 345,209

[22] Filed: Nov. 28, 1994

Related U.S. Application Data

[63] Continuation of Ser. No. 12,334, Feb. 2, 1993, abandoned.

[51] Int. Cl.[6] ..... G09F 21/02; A63H 3/14

[52] U.S. Cl. ..... 40/586; 446/327

[58] Field of Search ..... 40/586, 537, 405, 588; 116/35 R, 306; 446/327, 329

[56] References Cited

U.S. PATENT DOCUMENTS

| | | | |
|---|---|---|---|
| 2,840,590 | 7/1958 | Cotler | 446/329 |
| 3,611,628 | 10/1971 | Noble et al. | 446/327 |
| 3,916,537 | 11/1975 | Gilligan et al. | 446/329 |
| 4,094,083 | 6/1978 | Fund | 40/588 X |
| 4,455,963 | 6/1984 | Matsuo | 116/306 |
| 4,486,975 | 12/1984 | Harreld et al. | 446/220 |
| 5,117,507 | 6/1992 | Long | 446/329 |

FOREIGN PATENT DOCUMENTS

| | | | |
|---|---|---|---|
| 2181290 | 4/1987 | United Kingdom | 40/586 |

*Primary Examiner*—Kenneth J. Dorner
*Assistant Examiner*—Joanne Silbermann
*Attorney, Agent, or Firm*—Klauber & Jackson

[57] ABSTRACT

A movable hand sign 10 formed of several pieces of material 12,14,16,18 and a pair of inserts 20,22 for concealing and displaying advertisements or messages. The pieces of material 12,14,16,18 and the inserts 20,22 are assembled by sewing or stitching the pieces of material 12,14,16,18 together and securing the inserts 20,22 between them. A hand pocket 24 is formed in the assembled hand sign 10 which accommodates a hand 28 and fingers 30 of a user. The hand 28 and fingers 30 control the position of the hand sign 10. When the hand sign 10 is in a first position, a first surface 32 of a first piece of material 12 is displayed, a second surface 34 of a fourth piece of material 18 is displayed, and a third surface 36 of a third piece of material 16 is concealed. When the hand sign 10 is in a second position, the third surface 36 of the third piece of material 16 is displayed, the second surface 34 of the fourth piece of material 18 is displayed, and the first surface 32 of the first piece of material 12 is concealed. The advertisements or messages are printed on the surfaces 32,34,36 of the pieces of material 12,16,18.

24 Claims, 6 Drawing Sheets

MOVABLE HAND SIGN AND METHOD OF ASSEMBLING THE SAME

This application is a continuation of application Ser. No. 08/012,334, filed Feb. 2, 1993, now abandoned.

BACKGROUND OF THE INVENTION

1. Field of the Invention

The present invention relates to novelty devices that are used for advertising and promotional purposes and, more particularly, to a hand sign that is movable by a hand of a user so as to allow advertisements or messages to be concealed and displayed.

2. Description of the Prior Art

The use of novelty devices for promotional purposes is well known to those who attend or otherwise participate in events where there are a large number of viewing spectators, such as sporting competitions, political conventions, and the like. In past years such promotional novelties have included pins, hats, shirts, banners, and other similar types of devices. These devices were generally used to display logos, slogans, and messages, and allowed a user to express support for a particular individual, team, or cause.

In recent years interest in expressing support, whether it may be for an individual, a team, or a cause, has increased dramatically. In response to this increased interest, larger auditoriums, sports arenas, and stadiums have been built to accommodate a greater number of spectators. Also, television coverage of many events has expanded, thereby increasing the total number of home viewing spectators.

As a result of this overall increase in spectators, those spectators who attend the events often find themselves unable to individually express their support with others in attendance, with the individual, team, or cause that they support, or with the home viewing spectators, due to the large crowds that are in attendance. In other words, the spectators in attendance become lost in the crowd.

To overcome this problem, efforts have been made to develop novelty devices that allow spectators in attendance to better communicate their support and enthusiasm. For example, U.S. Pat. Nos. 4,486,975 and 4,455,963 each disclose promotional novelty devices that allow spectators to better express their support at crowded events. Thus, these novelty devices allow spectators in attendance to stand out in the crowd. A brief description of these prior art devices is now given.

Harreld et al, U.S. Pat. No. 4,486,975, discloses an inflatable novelty device that fits over a hand of a user. The device may take several different forms, but most commonly takes the form of an enlarged hand expressing a numeral one or a victory signal.

Matsuo, U.S. Pat. No. 4,455,963, discloses an enlarged hand simulator that also fits over a hand of a user. This device is configurable as desired by the user, wherein fingers of the device may be extended or clenched to form a limited number of supportive hand gestures. This device also allows logos, slogans, or messages to be displayed on both sides of the hand simulator at its palm.

Although both of the above-mentioned prior art devices provide spectators with a better means with which to express support, neither device is in any way movable by the hand of the user so as to control what form of support is to be expressed. Furthermore, neither device allows advertisements or messages to be concealed and subsequently displayed by the user, or vice versa. Such device movement and the ability to conceal and display advertisements or messages is often desirable by the user, or spectator, so as to provide a quick change between advertisements or messages being displayed, and to provide as many different means of expressing support as possible. It is therefore desirable to overcome the shortcomings of the above-mentioned prior art devices in these areas, while providing spectators with promotional novelty devices that better communicates their support and enthusiasm.

SUMMARY OF THE INVENTION

The present invention contemplates a movable hand sign that fits over a hand of a user and that is movable by the hand of the user so as to allow advertisements or messages to be concealed and displayed. The hand sign may take many shapes and sizes, and may display any number of advertisements or messages. Thus, the hand sign may essentially serve an unlimited number of advertising and promotional purposes.

The hand sign is preferably constructed of several pieces of nylon or some other lightweight material, and a pair of plastic or cardboard inserts. The inserts are cut or formed to a desired shape and size, and the pieces of material are sewn or stitched either through or around the borders of the inserts. When all of the pieces of material and the inserts are assembled together, a hand pocket is formed for the hand of the user. From inside the hand pocket, the hand of the user controls the position of the hand pocket so as to allow advertisements or messages to be concealed and displayed on the surfaces of the hand sign.

From the above descriptive summary it is thus apparent how the present invention movable hand sign overcomes the shortcomings of the above-mentioned prior art devices.

Accordingly, the primary objective of the present invention is to provide a promotional novelty device that allows a user to uniquely express support and enthusiasm for a particular individual, team, or cause.

Other objectives and advantages of the present invention will become apparent to those skilled in the art upon reading the following detailed description and claims, in conjunction with the accompanying drawings which are appended hereto.

BRIEF DESCRIPTION OF THE DRAWINGS

In order to facilitate a fuller understanding of the present invention movable hand sign, reference is now made to the appended drawings. The drawings should not be construed as limiting the present invention, but are intended to/be exemplary only.

PREFERRED EMBODIMENT OF THE PRESENT INVENTION

Figure 1:
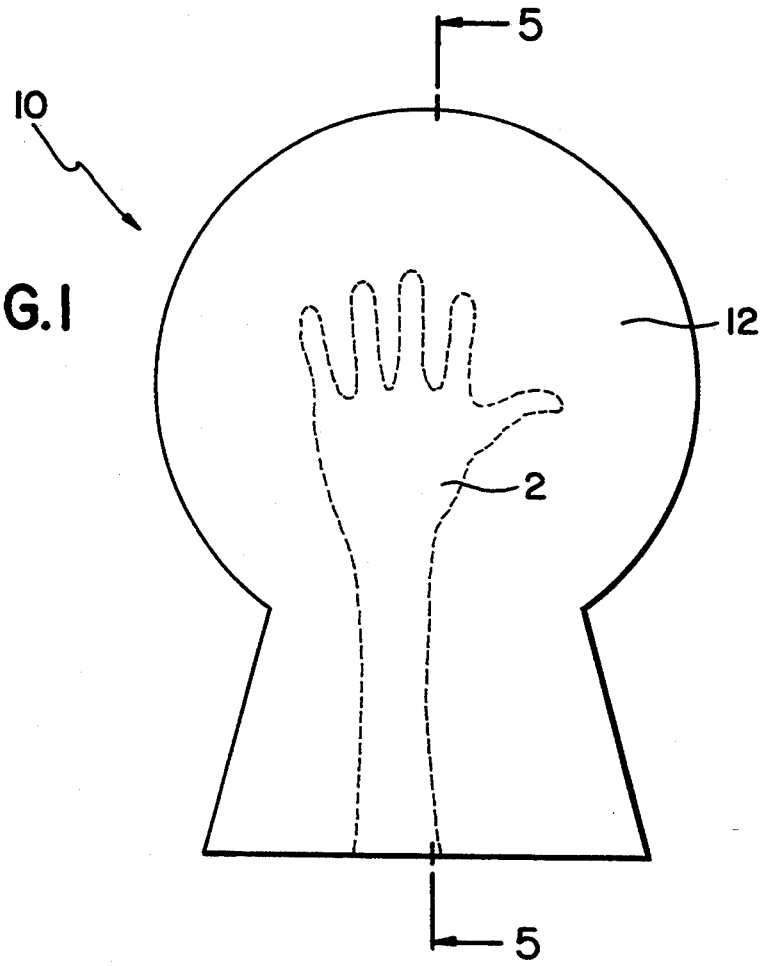
FIG. 1 is a front view of a fully assembled movable hand sign according to the present invention, wherein the hand signals shown in a first position.

Referring to FIG. 1, there is shown a front view of a fully assembled present invention movable hand sign 10 in a first position. In this view there is shown a first piece of material 12, upon which an advertisement or message may be printed. Also shown is a dotted line image 2 of a user's hand that is used to control the position of the hand sign 10. The hand 2 is shown in a corresponding first position.

Figure 2:
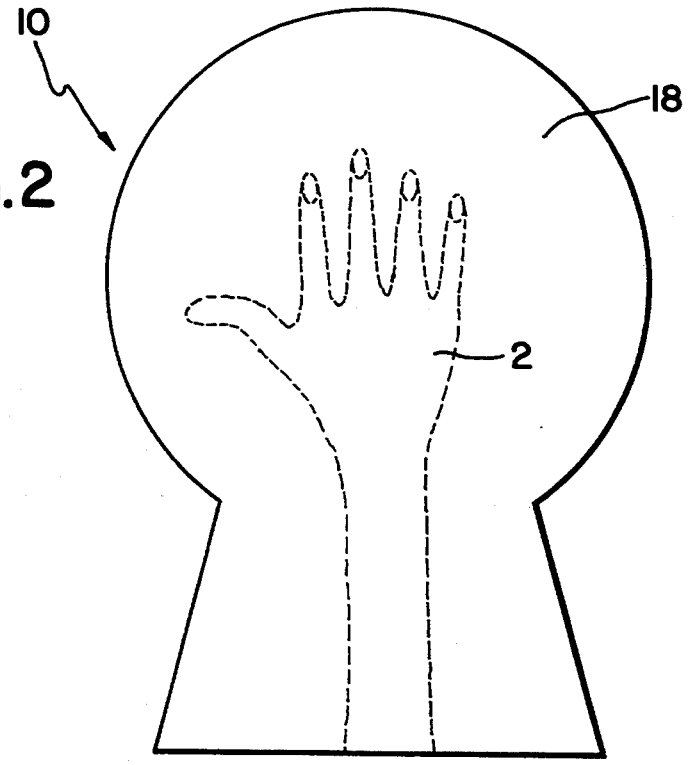
FIG. 2 is a rear view of the fully assembled movable hand sign of FIG. 1, wherein the hand sign is again shown in the-first position.

Referring to FIG. 2, there is shown a rear view of the fully assembled present invention movable hand sign 10 again in the first position. In this view there is shown a fourth piece of material 18, upon which an advertisement or message may be printed. Again there is shown the dotted line image 2 of the user's hand in the corresponding first position.

Figure 3:
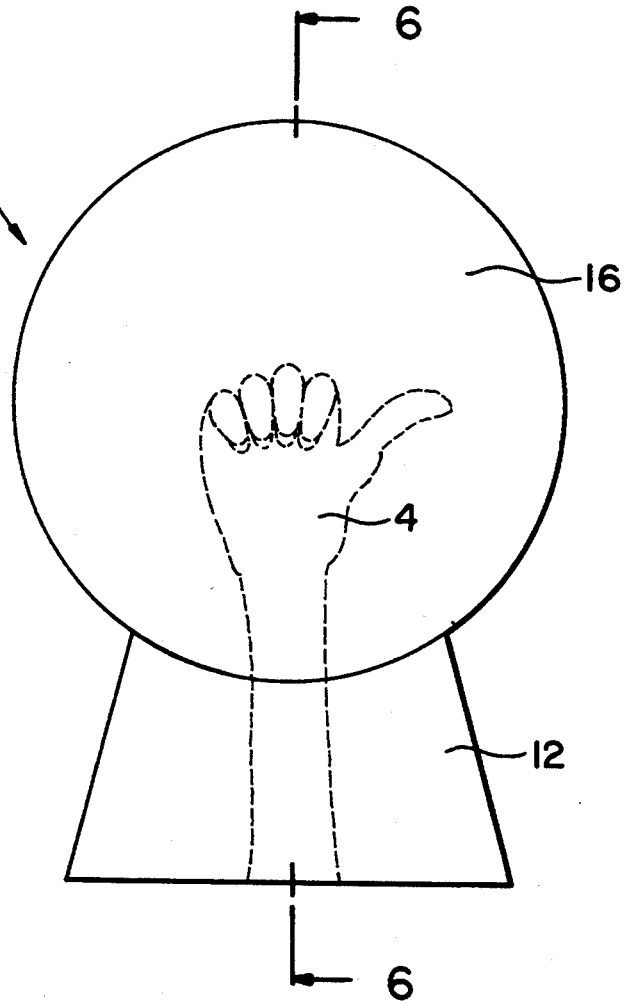
FIG. 3 is a front view of the fully assembled movable hand sign of FIG. 1, wherein the hand sign is shown in a second position.

Referring to FIG. 3, there is shown a front view of the fully assembled present invention movable hand sign 10 in a second position. In this view there is shown a third piece of material 16, upon which an advertisement or message may be printed. Also shown is a dotted line image 4 of a user's hand in a corresponding second position.

Figure 4:
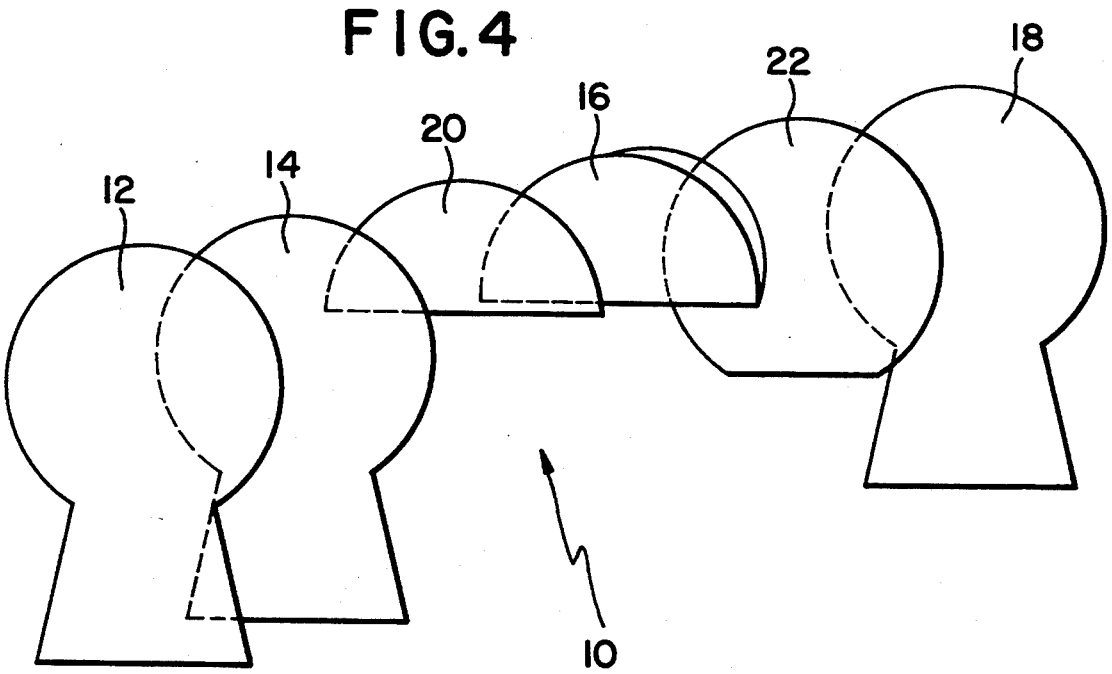
FIG. 4 is an exploded assembly view of the movable hand sign of FIG. 1.

Referring to FIG. 4, there is shown a three dimensional exploded assembly view of the present invention movable hand sign 10. In this view there is shown the first piece of material 12, a second piece of material 14, the third piece of material 16, the fourth piece of material 18, a first insert 20, and a second insert 22. As will be discussed shortly, the hand sign 10 is assembled by sewing or stitching together the pieces of material 12,14,16,18 at various locations, and either sewing or stitching the inserts 20,22 along with the pieces of material 12,14,16,18 or securing the inserts 20,22 between the sewn or stitched pieces of material 12,14,16,18.

Figure 5:
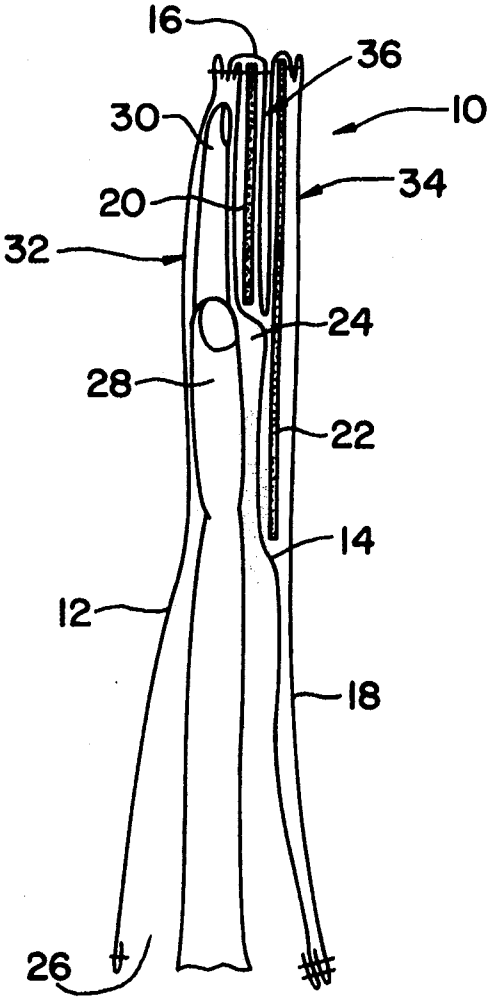
FIG. 5 is a right side cross-sectional view of the fully assembled movable hand sign of FIG. 1 taken along line 5—5 of FIG. 1.
Figure 7A:
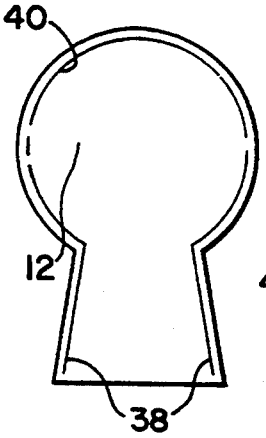
FIG. 7 is a collection of the several pieces of material that are used to make the movable hand sign of FIG. 1.
Figure 7B:
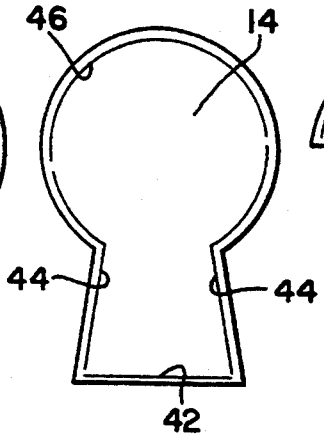
Figure 7C:
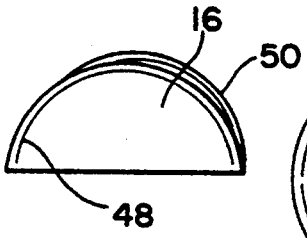
Figure 7D:
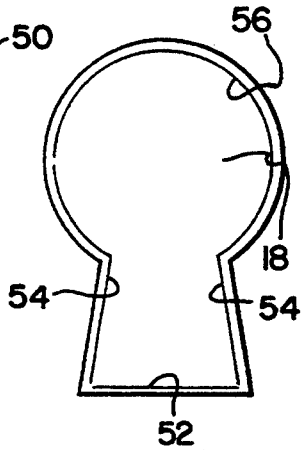

Referring to FIG. 5, there is shown a right side cross-sectional view of the fully assembled present invention movable hand sign 10 in the first position. In this view there is shown a hand pocket 24, which is formed between the first 12 and the second 14 pieces of material. The hand pocket 24 is shown in a corresponding first position. Access to the hand pocket 24 is through an opening 26 along the bottom of the hand sign 10 between the first 12 and the second 14 pieces of material. A hand 28 of a user is also shown having fingers 30 extended in a corresponding first position. Generally, the user inserts his or her hand 28 through the opening 26 and into the hand pocket 24 with the fingers 30 extended, to set the hand pocket 24 and the hand sign 10 in their respective first positions. When the hand sign 10 is in this first position, an advertisement or message may be displayed on a first surface 32 of the first piece of material 12 and on a second surface 34 of the fourth piece of material 18, and an advertisement or message may be concealed on a third surface 36 of the third piece of material 16. The advertisements or messages are printed on the surfaces 32,34,36 of the pieces of material 12,18,16, respectively.

Figure 6:
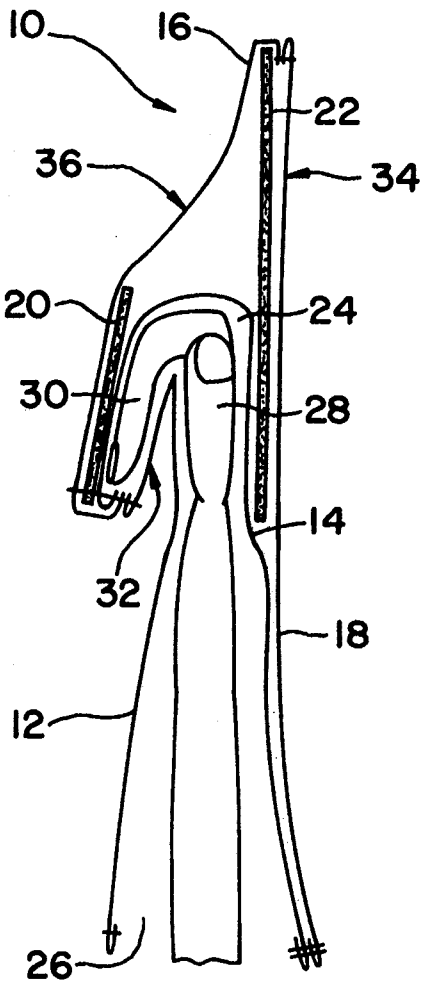
FIG. 6 is a right side cross-sectional view of the fully assembled movable hand sign of FIG. 3 taken along line 6—6 of FIG. 3.

Referring to FIG. 6, there is shown a right side cross-sectional view of the fully assembled present invention movable hand sign 10 in the second position. In this view the hand pocket 24, is shown in a corresponding second position Access to the hand pocket 24 is still through the opening 26 along the bottom of the hand sign 10 between the first 12 and the second 14 pieces of material. Also shown is the hand 28 of the user with its fingers 30 clenched in a corresponding second position. Generally, the user inserts his or her hand 28 through the opening 26 and into the hand pocket 24 with the fingers 30 extended, and then clenches his or her fingers 30 to set the hand pocket 24 and the hand sign 10 in their respective second positions. When the hand sign 10 is in this second position, an advertisement or message may be displayed on the third surface 36 of the third piece of material 16 and on the second surface 34 of the fourth piece of material 18, and an advertisement or message may be concealed on the first surface 32 of the first piece of material 12. Again, the advertisements or messages are printed on the surfaces 36,34,32 of the pieces of material 16,18,12, respectively.

Referring to FIG. 7, there is shown the first piece of material 12, the second piece of material 14, the third piece of material 16, and the fourth piece of material 18. On all four pieces of material 12,14,16,18 are a number of stitch patterns 38,40,42,44,46,48,50,52,54,56, which indicate where the pieces of material 12,14,16,18 are sewn or stitched together. The first piece 12, the second piece 14, and the fourth piece 18 are sewn or stitched together along stitch patterns 38,44, and 54, respectively. The first piece 12, the second piece 14, and the third piece 16 are sewn or stitched together along stitch patterns 40,46, and 48, respectively. The second piece 14 and the fourth piece 18 are sewn or stitched together along stitch patterns 42 and 52, respectively. The third piece 16 and the fourth piece 18 are sewn or stitched together along stitch patterns 50 and 516, respectively. As discussed earlier, the inserts 20,22 may be either sewn or stitched along with the pieces of material 12,14,16,18 or secured between the sewn or stitched pieces of material 12,14,16,18. It should be noted that the first insert 20 is preferably sewn or stitched along with the first 12, second 14, and third 16 pieces of material along stitch patterns 40,46, and 48, respectively, so as to positively secure this insert 20 when the hand sign 10 is changed between its first and second positions.

Referring again to FIG. 4, the four pieces of material 12,14,16,18 may be made of any number of lightweight materials or blends of lightweight materials, such as nylon or polyvinyl, respectively. The materials used should be lightweight to prevent excessive hand perspiration, and to prevent user fatigue since the hand sign 10 will usually be raised when in use. Furthermore, it is preferred that the material used be waterproof or be made water and/or soil resistant since the hand sign 10 will often be used outdoors.

The two inserts 20,22 may be made of any number of materials that possess somewhat rigid qualities so as to maintain the shape of the hand sign 10, such as cardboard or plastic. The materials used should also be lightweight so as to prevent user fatigue, as previously discussed. Furthermore, the materials used should be waterproof if the hand sign 10 is to be used outdoors so as to prevent its deterioration. Moreover, it is preferred that the materials used be somewhat deformable so as not to be easily broken or shattered.

Figure 8:
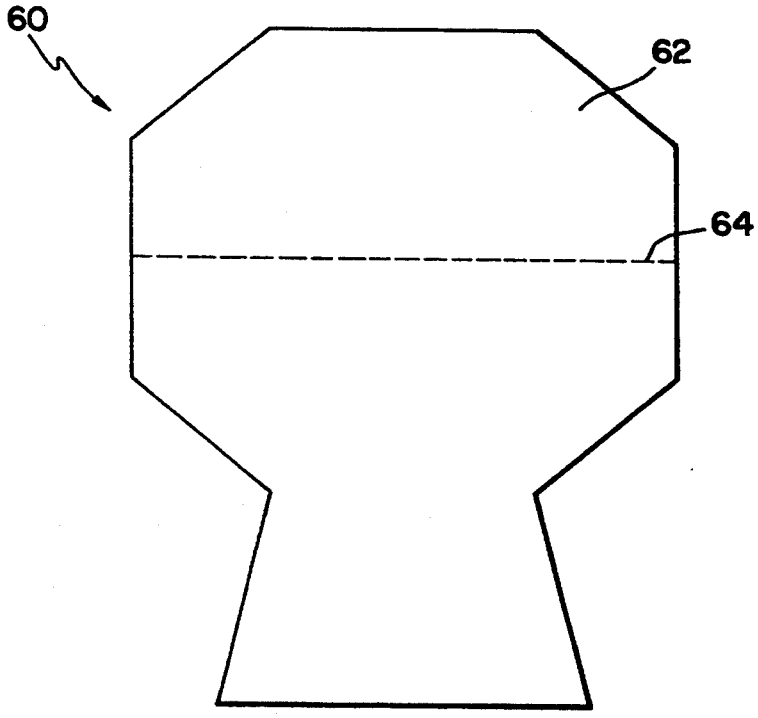
FIG. 8 is a front view of a fully assembled movable hand sign according to the present invention, wherein the hand sign has an octagonal shape and is shown in a first position.

It should be noted that the present invention may take any number of shapes and sizes. Referring to FIG. 8, there is shown a front view of a present invention movable hand sign 60 having an octagonal shape. Although not required, it is preferred that the display surface 62 of the hand sign 60 be symmetric across a center line 64, so that the hand sign 60 will display similarly shaped advertisements or messages in both the first and second positions.

Figure 9:
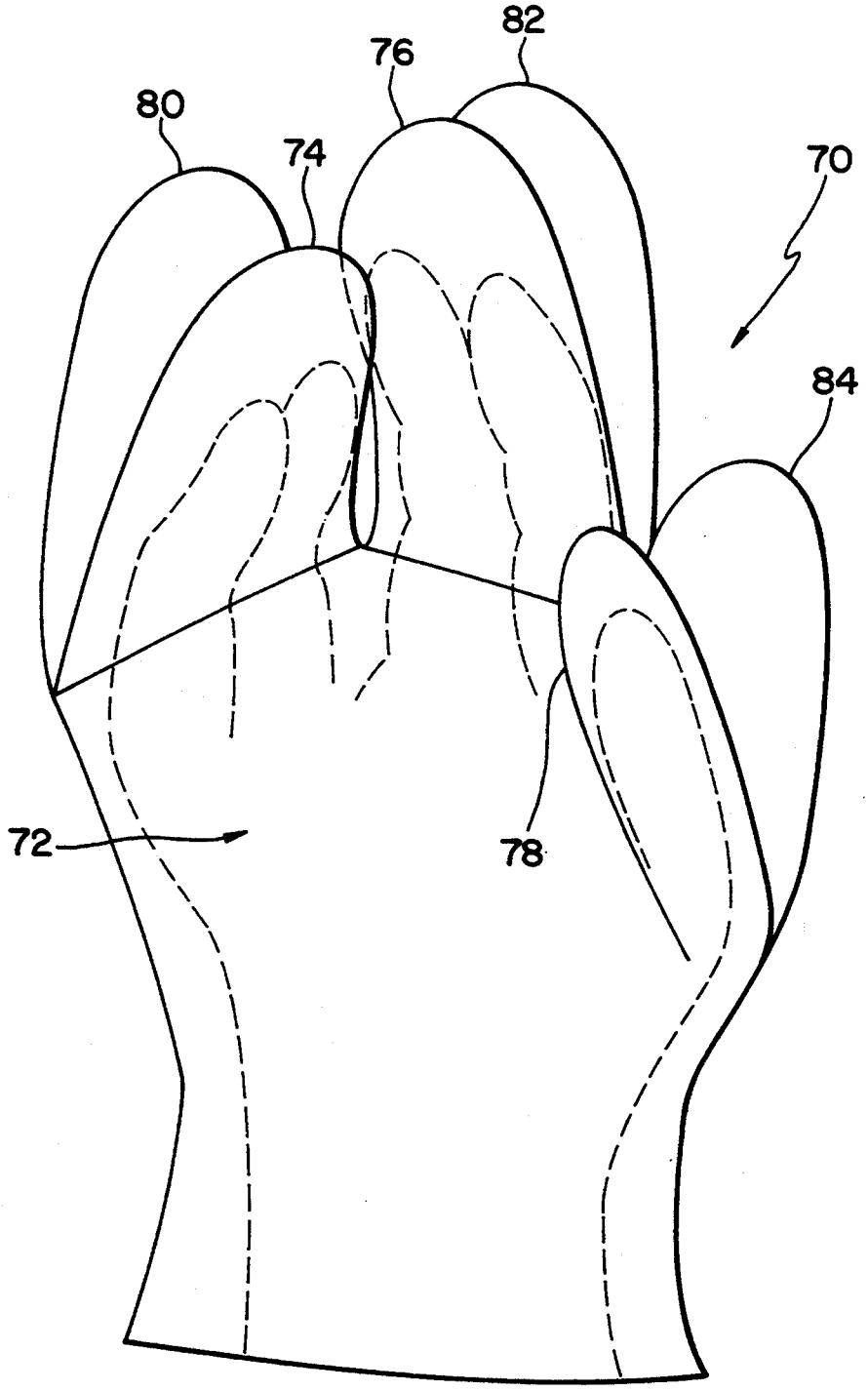
FIG. 9 is a front view of an alternate embodiment of a fully assembled movable hand sign according to the present invention, wherein the hand sign is shown in a first position.
Figure 10:
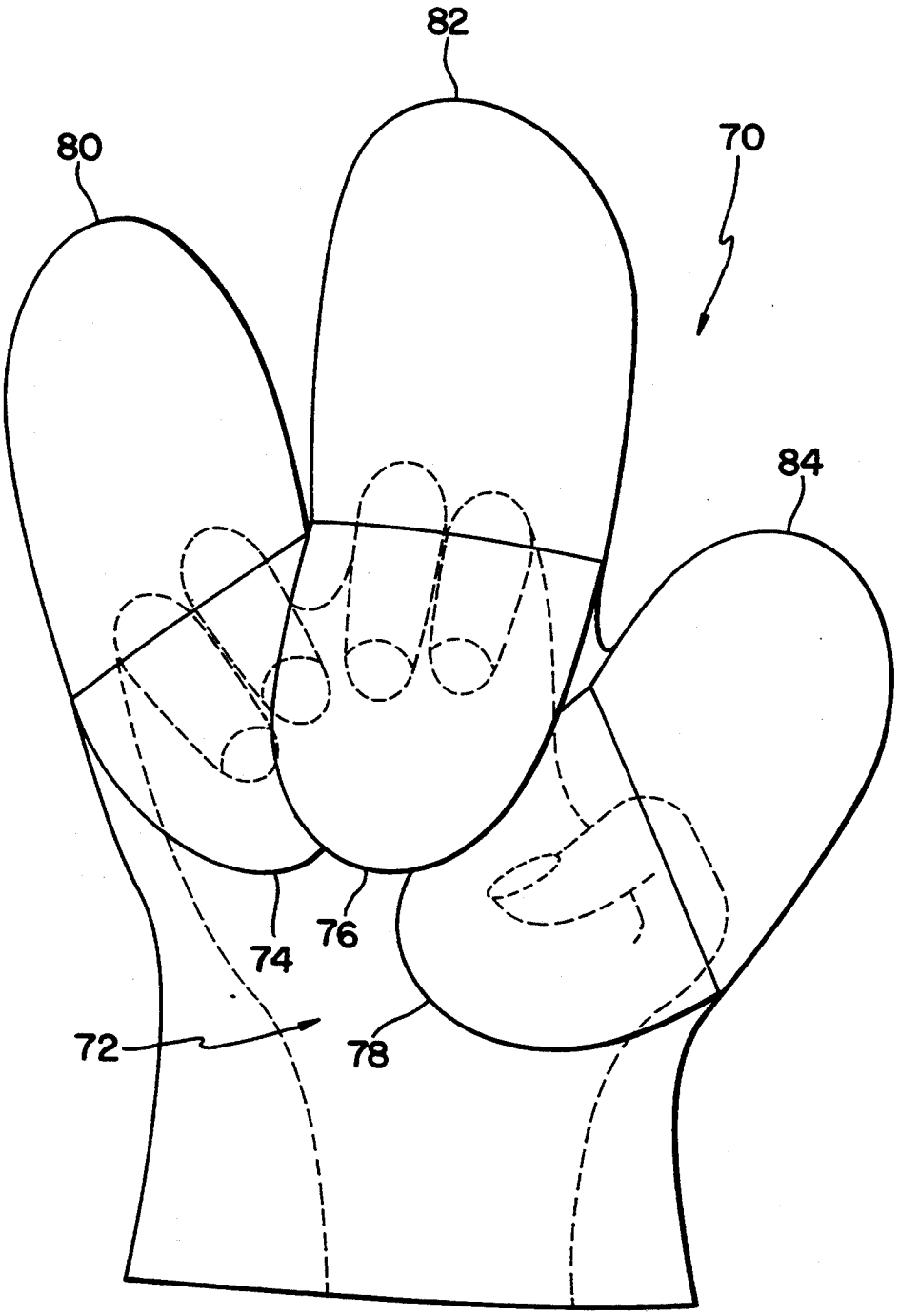
FIG. 10 is a front view of the fully assembled movable hand sign of FIG. 9, wherein the hand sign is shown in a second position.

Referring to FIG. 9, there is shown a front view of an alternate embodiment of a fully assembled present invention movable hand sign 70 in a first position. This alternate embodiment hand sign 70 is constructed and operates in a manner similar to the hand signs 10,60 shown in FIGS. 1 through 8, except that the hand pocket 24 is transformed into a hand glove 72 with three separately movable glove members 74,76,78. Corresponding to each movable glove member 74,76,78 are stationary limb members 80,82,84, respectively, having correspondingly similar shapes. Since the glove members 74,76,78 are separately movable a greater number of advertisements or messages may be displayed or concealed on the various surfaces of the glove members 74,76,78 and limb members 80,82,84. Referring to FIG. 10, a front view of the alternate embodiment movable hand sign 70 is shown with the glove members 74,76,78 in a second position.

With the present invention movable hand signs 10,60,70 now fully described it can thus be seen that the primary objective set forth above is efficiently attained and, since certain changes may be made in the above described hand signs 10,60,70 without departing from the scope of the invention, it is intended that all matter contained in the above description or shown in the accompanying drawings shall be interpreted as illustrative and not in a limiting sense.

What is claimed is:

1. A movable hand sign for concealing and displaying advertisements or messages, said movable hand sign comprising:

a hand covering having a pocket structure with a movable pocket member, said movable pocket member having a first surface and a second surface, said movable pocket member being movable between a first position and a second position; and a stationary limb member corresponding to said movable pocket member, said stationary limb member having a non-invasive structure that is integral with said hand covering, said stationary limb member having a first surface and a second surface, said second surface of said movable pocket member being an extension of said first surface of said corresponding stationary limb member, wherein said first position of said movable pocket member results in said second surface of said movable pocket member and said first surface of said corresponding stationary limb member being cooperatively concealed, said first surface of said movable pocket member being separately displayed, and said second surface of said stationary limb member being separately displayed, and wherein said second position of said movable pocket member results in said second surface of said movable pocket member and said first surface of said corresponding stationary limb member being cooperatively displayed, said first surface of said movable pocket member being separately concealed, and said second surface of said stationary limb member being separately displayed.

2. The movable hand sign as defined in claim 1, wherein said movable pocket member and said corresponding stationary limb member are constructed so as to have similar shapes.

3. The movable hand sign as defined in claim 2, wherein said hand covering with said movable pocket member and said corresponding stationary limb member are constructed of a plurality of pieces of material that are sewn or stitched together.

4. The movable hand sign as defined in claim 3, wherein said plurality of pieces of material are made of a lightweight fabric.

5. The movable hand sign as defined in claim 4, wherein said plurality of pieces of material are made of nylon.

6. The movable hand sign as defined in claim 3, wherein said hand covering with said movable pocket member and said corresponding stationary limb member are further constructed of a plurality of inserts so as to provide rigidity for maintaining the shapes of said movable pocket member and said corresponding stationary limb member, wherein said plurality of inserts are sewn or stitched along with said plurality of pieces of material or secured between said sewn or stitched plurality of pieces of material.

7. The movable hand sign as defined in claim 6, wherein said plurality of inserts are made of a lightweight material that is somewhat deformable.

8. The movable hand sign as defined in claim 7, wherein said plurality of inserts are made of plastic.

9. The movable hand sign as defined in claim 7, wherein said plurality of inserts are made of cardboard.

10. The movable hand sign as defined in claim 2, wherein said hand covering with said movable pocket member and said corresponding stationary limb member are constructed of a first piece of material, a second piece of material, a third piece of material, and a fourth piece of material, and wherein said first piece of material, said second piece of material, said third piece of material, and said fourth piece of material are sewn or stitched together at various locations.

11. The movable hand sign as defined in claim 10, wherein said hand covering with said movable pocket member and said corresponding stationary limb member are further constructed of a first insert and a second insert so as to provide rigidity for maintaining the shapes of said movable pocket member and said corresponding stationary limb member, and wherein said first insert and said second insert are sewn or stitched along with said first piece of material, said second piece of material, said third piece of material, and said fourth piece of material or secured between said sewn or stitched second piece of material, third piece of material, and fourth piece of material.

12. The movable hand sign as defined in claim 2, wherein said movable pocket member and said corresponding stationary limb member both have a circular shape.

13. The movable hand sign as defined in claim 2, wherein said movable pocket member and said corresponding stationary limb member both have a polygonal shape.

14. A movable hand sign for concealing and displaying advertisements or messages, said movable hand sign comprising:

a hand covering having a glove structure with at least one movable glove member, each said movable glove member having a first surface and a second surface, each said movable glove member being movable between a first position and a second position; and at least one stationary limb member corresponding to said at least one movable glove member, each said stationary limb member having a non-invasive structure that is integral with said hand covering, each said stationary limb member having a first surface and a second surface, said second surface of each said movable glove member being an extension of said first surface of each said corresponding stationary limb member, wherein said first position of each said movable glove member results in said second surface of each said movable glove member and said first surface of each said corresponding stationary limb member being cooperatively concealed, said first surface of each said movable glove member being separately displayed, and said second surface of each said stationary limb member being separately displayed, and wherein said second position of each said movable glove member results in said second surface of each said movable glove member and said first surface of each said corresponding stationary limb member being cooperatively displayed, said first surface of each said movable glove member being separately concealed, and said second surface of each said stationary limb member being separately displayed.

15. The movable hand sign as defined in claim 14, wherein each said movable glove member and each said corresponding stationary limb member are constructed so as to have similar shapes.

16. The movable hand sign as defined in claim 15, wherein said hand covering with each said movable glove member and each said corresponding stationary limb member are constructed of a plurality of pieces of material that are sewn or stitched together.

17. The movable hand sign as defined in claim 16, wherein said plurality of pieces of material are made of a lightweight fabric.

18. The movable hand sign as defined in claim 17, wherein said plurality of pieces of material are made of nylon.

19. The movable hand sign as defined in claim 16, wherein said hand covering with each said movable glove member and each said corresponding stationary limb member are further constructed of a plurality of inserts so as to provide rigidity for maintaining the shapes of each said movable glove member and each said corresponding stationary limb member, wherein said plurality of inserts are sewn or stitched along with said plurality of pieces of material or secured between said sewn or stitched plurality of pieces of material.

20. The movable hand sign as defined in claim 19, wherein said plurality of inserts are made of lightweight material that is somewhat deformable.

21. The movable hand sign as defined in claim 20, wherein said plurality of inserts are made of plastic.

22. The movable hand sign as defined in claim 20, wherein said plurality of inserts are made of cardboard.

23. The movable hand sign as defined in claim 15, wherein said hand covering with each said movable glove member and each said corresponding stationary limb member are constructed of a first piece of material, a second piece of material, a third piece of material, and a fourth piece of material, and wherein said first piece of material, said second piece of material, said third piece of material, and said fourth piece of material are sewn or stitched together at various locations.

24. The movable hand sign as defined in claim 23, wherein said hand covering with each said movable glove member and each said corresponding stationary limb member are further constructed of a plurality of inserts so as to provide rigidity for maintaining the shapes of each said movable glove member and each said corresponding stationary limb member, and wherein said plurality of inserts are sewn or stitched along with said first piece of material, said second piece of material, said third piece of material, and said fourth piece of material or secured between said sewn or stitched second piece of material, third piece of material, and fourth piece of material.

* * * * *